US006358108B2

(12) United States Patent
Murata et al.

(10) Patent No.: US 6,358,108 B2
(45) Date of Patent: Mar. 19, 2002

(54) OUTBOARD MOTOR

(75) Inventors: Hiroyuki Murata; Hiroyuki Yoshida, both of Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/767,508

(22) Filed: Jan. 23, 2001

(30) Foreign Application Priority Data

Feb. 7, 2000 (JP) ..... 2000-028844

(51) Int. Cl.[7] ..... B63H 21/10
(52) U.S. Cl. ..... 440/88; 440/89; 440/900
(58) Field of Search ..... 440/88, 89, 900

(56) References Cited

U.S. PATENT DOCUMENTS 5,937,801 A * 8/1999 Davis ..... 440/89
6,012,956 A * 1/2000 Mishima et al. ..... 440/88

FOREIGN PATENT DOCUMENTS

JP 04050097 2/1992

* cited by examiner

*Primary Examiner*—Stephen Avila
(74) *Attorney, Agent, or Firm*—Adams & Wilks

(57) ABSTRACT

An outboard motor includes a first case and a second case disposed below the first case. The first case houses therein an oil pan and an upper part of a drive shaft. Within the oil pan, engine oil is held. The second case has its upper edge portion coupled to a lower edge portion of the first case. The second case has a vertical wall disposed therewithin. The vertical wall separates a space within the second case into a cavity and part of an exhaust passage through which exhaust gas passes. The cavity is formed below the oil pan. This arrangement prevents the oil pan from being affected by heat of the exhaust gas. Thus, it becomes possible to prevent the engine oil held within the oil from increasing in temperature.

4 Claims, 6 Drawing Sheets

OUTBOARD MOTOR

BACKGROUND OF THE INVENTION

1. Field of the Invention

The present invention relates generally to an outboard motor attached to the stern of a boat and designed to produce a force required to thrust the boat, and in particular to an oil pan positioned below an engine of the outboard motor and a vertical wall disposed to be cooled down together with the oil pan and to form an exhaust passage such that the oil pan is protected from the heat of exhaust gas passing through the exhaust passage.

2. Description of the Related Art

Oil pans for holding engine oil are typically disposed below four-cycle engines of outboard motors. Such oil pans can be heated by the heat of exhaust gas passing through exhaust pipes connected to the engines. It is therefore necessary for the oil pans to be cooled down. A technique for protecting the oil pans from the heat of the exhaust gas is disclosed, for example, in Japanese Laid-Open Publication No. HEI-4-50097 entitled "EXHAUST DEVICE FOR OUTBOARD MOTOR".

The disclosed outboard motor includes an upper casing positioned below an engine. Within the upper casing, there is disposed an oil pan. The oil pan is channel-shaped in vertical cross-section. The oil pan has a recessed part. Adjacent the recessed part, there is formed a vertically extending water passage. An exhaust pipe vertically extends within the water passage. The exhaust pipe has its lower end portion located below the oil pan. The lower end portion of the exhaust pipe is in communication with a first exhaust expansion compartment. The first exhaust expansion compartment is in communication with a second exhaust expansion compartment. The second exhaust expansion compartment is provided above the first exhaust expansion compartment. Exhaust gas discharged from the engine flows through the exhaust pipe and the first exhaust expansion compartment up into the second exhaust expansion compartment. The upper casing has a lid disposed therewithin. The lid lies to separate the oil pan from the first exhaust expansion compartment, such that the heat of the exhaust gas in the first exhaust expansion compartment is prevented from affecting the oil pan. In other words, by virtue of the lid, the oil pan is cut off from the heat of the exhaust gas in the exhaust expansion compartment which would otherwise be transmitted thereto.

The exhaust pipe and an outer wall of the oil pan cooperate with each other to define a space therebetween. The water passage is formed along part of the periphery of the exhaust pipe. Part of cooling water for cooling the engine passes through the water passage to thereby cool the exhaust pipe.

To provide the thus arranged outboard motor, the lid for separating the first exhaust expansion compartment from the bottom of the oil pan positioned at great depths within the upper casing should be mounted in such a manner as to extend transversely of the upper casing.

The outboard motor is comprised of an engine case within which the engine having a vertically extending crankshaft is housed, the upper casing mounted to a lower part of the engine case, and a gear case connected to a lower part of the upper casing. The upper casing has the oil pan and the like surrounded by an upper inner surface thereof. The outboard motor thus arranged greatly extends in the vertical direction to thereby provide increased vertical dimension of the upper casing. The upper casing is therefore large in depth. It is thus difficult for the lid to be lain at a vertically central position within the upper casing of great depth.

Further, the aforementioned outboard motor is complicated in construction because: (1) The oil pan is disposed within the upper casing of great depth. (2) The longitudinally extending exhaust pipe is spaced from the outer wall of the oil pan. (3) The lid is positioned within the upper casing. (4) A passage for cooling water which has cooled the engine is provided outside a wall which forms the first exhaust expansion compartment. (5) The water passage is formed along the part of the periphery of the exhaust pipe. The outboard motor of such complicated construction undesirably requires the increased number of components.

SUMMARY OF THE INVENTION

An object of the present invention is to provide an outboard motor of simplified construction which can be readily made using the small number of components including an oil pan disposed to be unaffected by the heat of exhaust gas discharged from an engine of the outboard motor, so that oil held within the oil pan is prevented from increasing in temperature.

A further object of the present invention is to provide an outboard motor including an oil pan and a vertical wall disposed adjacent the oil pan to provide an exhaust passage, both of which are disposed to be cooled down simultaneously.

According to an aspect of the present invention, there is provided an outboard motor comprising: an engine having a vertically extending crankshaft; an oil pan disposed below a crankcase of said engine; a vertically extending drive shaft disposed to be driven by said crankshaft; a screw positioned at a lower end portion of said drive shaft, said screw extending perpendicularly to said drive shaft, said screw being disposed to be driven by said drive shaft through a gear transmission mechanism; a first case for housing therein said oil pan and an upper part of said drive shaft, said first case being disposed below said crankcase, said first case having a coupling surface coupled to said crankcase; a second case for housing therein a lower part of said drive shaft, said second case being disposed below said first case; a gear case for housing therein said gear transmission mechanism, said gear case being disposed below said second case; said first case having a vertical wall disposed therewithin to form an exhaust passage through which exhaust gas discharged from said engine passes, such that an outer wall of said oil pan is separated from said exhaust passage by said vertical wall; said second case having an upper edge portion coupled to a lower edge portion of said first case, said second case having a vertical wall disposed therewithin to form a cavity and an exhaust passage for discharging the exhaust gas into water.

The outboard motor of the present invention includes the first case and the second case. The first case has its lower edge portion coupled to an upper edge portion of the second case. Within the first case, there are housed the oil pan of large depth and the upper part of the drive shaft. By the vertical wall of the second case, the exhaust passage provided within the second case is separated from the cavity formed below the oil pan. With the thus arranged vertical wall, the least amount of the heat of exhaust gas passing through the exhaust passage affects the oil pan. Accordingly, engine oil held within the oil pan increases in temperature by the least amount.

The second case has the vertical wall corresponding in configuration to the vertical wall of the first case. The number of components required to provide the outboard motor can thus be reduced. The outboard motor of simple construction can be made using the reduced number of components. Such an outboard motor of simple construction is very easy to assemble or produce.

The engine oil is returned from the engine to the oil pan. The temperature of the engine oil thus returned is made relatively high by the heat of the engine. The engine oil of high temperature has been cooled down, to some extent, within the oil pan by the time it is resupplied to an engine block of the engine. The thus cooled engine oil can be therefore used to lubricate the engine. Consequently, it becomes possible to prevent the engine block and other components of the engine from increasing in temperature.

Further, since the exhaust gas is reduced in temperature, the engine makes a reduced noise when discharging the exhaust gas. Moreover, the heat of the exhaust gas passing through the exhaust passage affects the cases to a smaller extent.

In a preferred form of the present invention, said oil pan is formed integrally with said first case.

Accordingly, the oil pan and a portion of the first case for supporting the drive shaft is simple in construction. Since the oil pan is formed integrally with the first case, the first case can be readily made using the reduced number of components. Such a first case is coupled to the second case with reduced difficulty.

In a further preferred form of the present invention, the outboard motor includes a cooling water supply passage and water discharge passageways all of which are formed therein, said cooling water supply passage being positioned to supply said engine with cooling water for cooling said engine, said water discharge passageways being formed such that after cooling said engine, said cooling water flows out of said outboard motor by passing therethrough, at least one of said water discharge passageways being formed on a side of said outer wall of said oil pan provided inside said vertical wall.

Since the outer wall is disposed to be exposed to the cooling water, the cooling water passes over the outer wall, and thus effectively cools the oil held within the oil pan. With this arrangement, there is no need for such a particular cooling water passage structure as a water jacket for cooling the oil pan and the vertical wall. This simplifies the construction of the outboard motor. Thus, the outboard motor requires the reduced number of components.

In a still further preferred form of the present invention, the outboard motor includes a cooling water supply passage and water discharge passageways all of which are formed therein, said cooling water supply passage being positioned to supply said engine with cooling water for cooling said engine, said water discharge passageways being formed such that after cooling said engine, said cooling water flows out of said outboard motor by passing therethrough, at least one of said water discharge passageways being formed on a side of said exhaust passage provided outside said vertical wall.

The water discharge passageway is formed on the side of the exhaust passage. By flowing through the passageway, the cooling water lowers temperature in the exhaust passage. In addition, the cooling water cools the oil pan positioned adjacent the exhaust passage. The engine oil held in the oil pan can thus be effectively cooled. Accordingly, there is no need for such a particular cooling water passage structure as a water jacket for reducing temperature in the exhaust passage. This helps simplify the construction of the outboard motor. The outboard motor of simplified construction requires the reduced number of components.

With this arrangement, there can be minimized the extent to which the heat of the exhaust gas affects the engine disposed above the oil pan. There can be also minimized the extent to which temperature in an engine compartment is affected by the heat of the exhaust gas. In addition, it is unlikely that air to be taken into the engine increases in temperature. An output of the thus arranged outboard motor is not reduced when the engine operates at a high engine speed.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
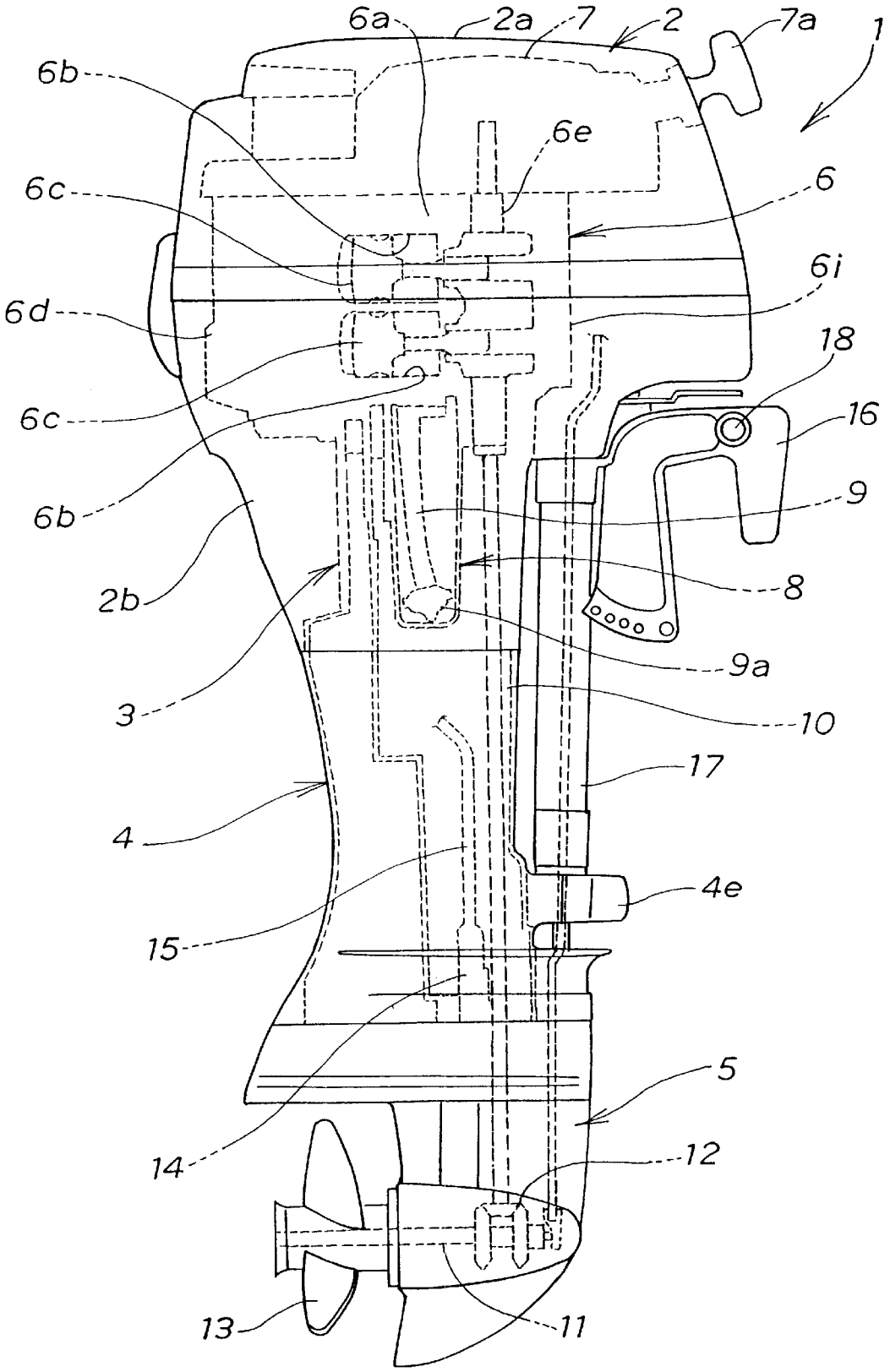
FIG. 1 is a schematic view of an outboard motor including inner components shown by broken lines.

Reference is made to FIG. 1. An outboard motor 1 includes an engine cover 2 provided at an uppermost part thereof, a gear case 5 located at a lowermost part thereof, a first case 3 positioned beneath the engine cover 2, and a second case 4 (an extension case) disposed beneath the first case 3. In this figure, the right side of the outboard motor 1 should be construed as a front side of the motor 1. Similarly, the left side of the motor 1 should be construed as a rear side of the motor 1. It will be appreciated that the front side of the outboard motor 1 corresponds to the direction of thrust of the motor 1.

A four-cycle engine 6 includes a cylinder block 6*a*. The cylinder block 6*a* has two lying cylinders 6b, 6*b* disposed therewithin. These cylinders 6*b*, 6*b* are vertically juxtaposed. Each cylinder 6*a* has a piston 6*c* fitted therein. Within a crankcase 6*i*, a crankshaft 6*e* extends vertically of the outboard motor 1. The cylinder block 6*a* has a cylinder head 6*d* (including a cylinder head cover) positioned leftwardly thereof.

The cylinder block 6*a*, the cylinder head 6*d*, and the crankcase 6*i* cooperate to provide an engine block.

Provided on the engine 6 is a starting device 7, that is, a recoil starter. The device 7 has a knob 7*a*. When pulled, the knob 7*a* draws a rope (not shown) to start the engine 6.

An oil pan 8 is disposed below the engine block. The oil pan 8 holds an engin oil therein. The oil pan 8 is connected to lower parts of the cylinder block 6*a* and the crankcase 6*i*.

The oil pan 8 is configured to define a downwardly extending compartment of given volume. The oil pan 8 houses therein an oil strainer 9*a*. The strainer 9*a* is located at an inner bottom portion of the oil pan 8. An oil suction pipe 9*a* functions to supply the engine oil to a variety of components of the engine 6 through the strainer 9*a*.

The engine 6 has its upper half part covered with an upper half portion 2*a* of the engine cover 2. A lower half part of the engine 6 and the oil pan 8 are covered with a lower half portion 2*b* of the engine cover 2.

The vertically extending crankshaft 6*e* has its lower end portion connected to an upper end portion 10*a* (see FIG. 3) of a long drive shaft 10 oriented vertically. The drive shaft 10 has its upper part housed in the first case 3. The drive shaft 10 has its lower part housed in the second case 4.

The drive shaft 10 has its lower end portion housed in the gear case 5. A horizontally oriented screw shaft 11 positioned in the gear case 5 is disposed to be driven by the drive shaft 10 via a gear transmission mechanism 12. The screw shaft 11 has a screw 13 attached to a rear end portion thereof. When the screw shaft 11 is driven, the screw 13 is operated to produce a force required to thrust a boat (not shownn).

A water pump 14 is disposed at a boundary part located between the second case 4 and the gear case 5. When operated, the pump 14 pumps sea water up and supplies the same to a cooling water supply pipe 15. The sea water passes through the pipe 15 out of a connection part 15*a* (see FIG. 4). The sea water then flows into a water jacket (not shown) of the engine 6. The sea water acts as cooling water. The outboard motor 1 includes a stern bracket 16. The stern bracket 16 is disposed to be attached to the stern (not shown) of the boat. The outboard motor 1 pivots horizontally about a swivel shaft 17 The outboard motor 1 pivots vertically about a tilt shaft 18.

Figure 2:
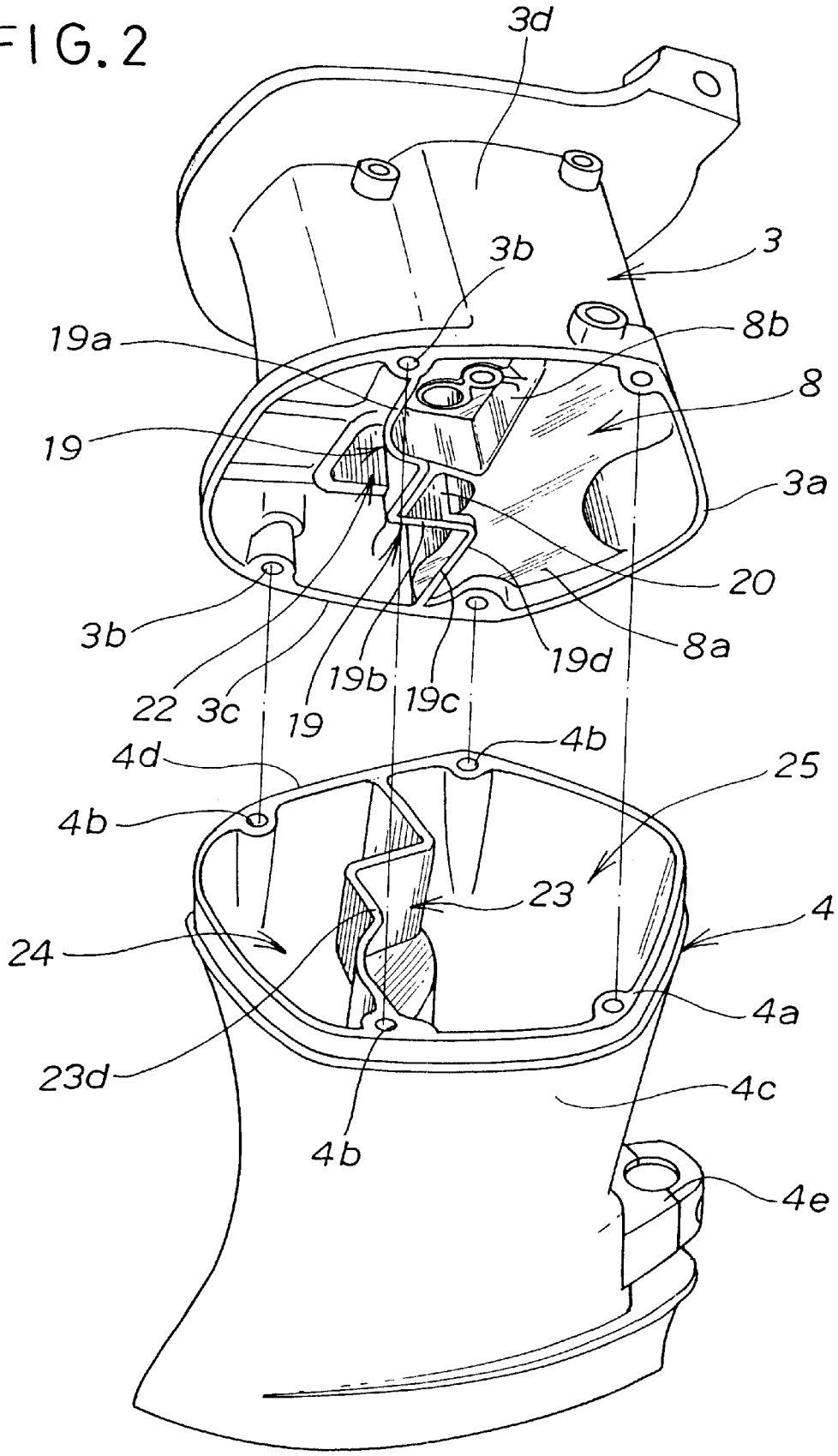
FIG. 2 is an exploded perspective view of a first case and a second case of the outboard motor of FIG. 1.
Figure 3:
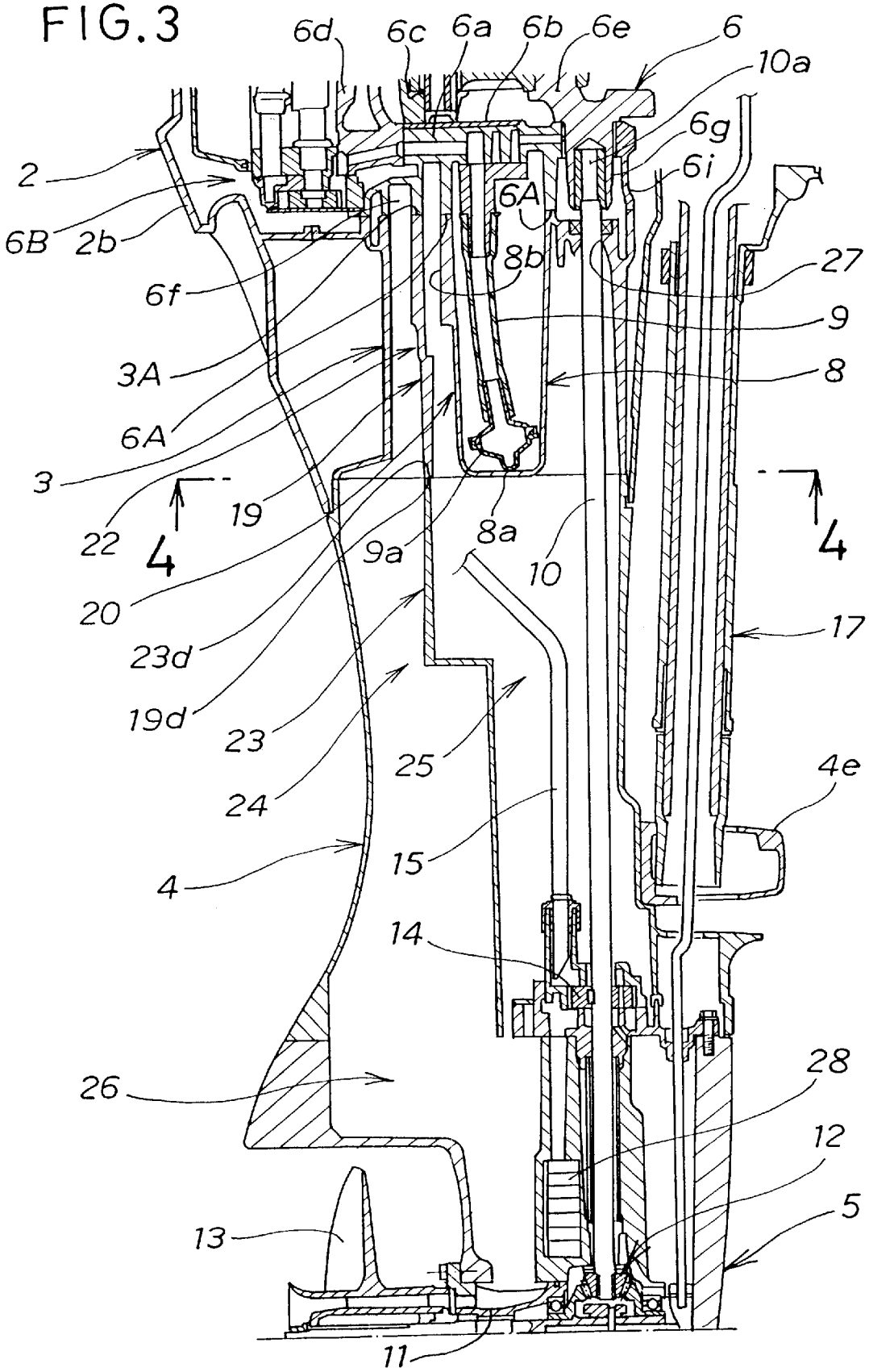
FIG. 3 is an enlarged vertical cross-sectional view of a lower half of the outboard motor.

The first and second cases 3, 4 are best shown in FIG. 2 and FIG. 3.

As shown in FIG. 2 and FIG. 3, the oil pan 8 is formed integrally with the inside of the first case 3. The oil pan 8 has its upper part opened to a lower part of the engine block. The oil pan 8 extends downwardly into the first case 3. The oil pan 8 has a bottom surface 8a positioned proximate the oil strainer 9*a*.

The first case 3 has a top surface 3A (hereinafter referred to as coupling surface) to be mated with a bottom surface 6A (hereinafter referred to as coupling surface) of the cylinder block 6*a* and the crankcase 6*i*. By these coupling surfaces 3A, 6A, an engine compartment is outlined.

The first case 3 includes a vertical wall 19 formed integrally with the inside thereof. The wall 19 is disposed centrally within the case 3.

The wall 19 extends laterally of the first case 3. The wall 19 also extends downwardly from the coupling surface 3A. The wall 19 is positioned behind an outer wall 8*b* of the oil pan 8. The wall 19 is comprised of a first wall portion 19*a*, a second wall portion 19*b*, and a third wall portion 19*c*. The first wall portion 19*a* extends from one side wall 3*d* of the first case 3 to the vicinity of an intermediate part of the outer wall 8*b*. The second wall portion 19*b* is continuous with the first wall portion 19*a*. The second wall portion 19*b* is L-shaped configuration when viewed in plan (see FIG. 4). The third wall portion 19*c* is contiguous with the second wall portion 19*b*. The third wall portion 19*c* extends to another side wall 3*c* of the case 3. The wall 3*c* is opposed to the wall 3*d*.

Located below the engine 6 is a first cooling water discharge passageway 20 extending vertically. The passageway 20 is formed between the second wall portion 19*b* and the outer wall 8*b*. Formed outside the second wall portion 19*b* is a second cooling water discharge passageway 21 (see FIG. 4). The passageway 21 takes the form of a duct. The passageway 21 extends vertically in parallel with the passageway 20.

Behind the vertical wall 19, there is formed an upper exhaust passage 22. The passage 22 is in communication with an exhaust port 6f of the engine 6. The passage 22 is separated from the passageway 20 by the second wall portion 19*b*. That is, the passage 22 is provided oppositely from the passageway 20. The passage 22 is formed remotely from the oil pan 8.

The first case 3 and the second case 4 have mounting apertures 3*b*, 4*b* formed therein, respectively. When the first and second cases 3, 4 are coupled together, a lower edge portion 3*a* of the case 3 is mated with an upper edge portion 4*a* of the case 4 with the apertures 3*b* aligned with the apertures 4*b*. The apertures 3*b*, 4*b* have bolts inserted thereinto.

The second case 4 has a vertical wall 23 disposed therein. The wall 23 divides an inner space, formed within the case 4, into a lower exhaust passage 24 and a cavity 25 serving as a lower half passage through which cooling water passes.

A bottom edge 19*d* of the wall 19 and a top edge 23*d* of the wall 23 have the same configuration as viewed in plan. The wall 23 has one end portion continuous with an interior surface of one side wall 4*c* of the case 4. Another end portion of the wall 23 is continuous with an interior surface of another side wall 4*d* of the case 4.

The top edge 23*d* is positioned to abut against the bottom edge 19*d*.

The swivel shaft 17 has its lower end portion supported by a supporting portion 4*e*.

With the top edge 23*d* abutting against the bottom edge 19*d*, the first case 3 and the second case 4 are coupled together. This allows the passage 22 to communicate with the passage 24. The passages 22, 24 cooperate with each other to form an exhaust passage which communicates with the exhaust port 6*f*. The passage 24 is in communication with a space 26 formed within the gear case 5. The flow of exhaust gas will be explained later.

Figure 4:
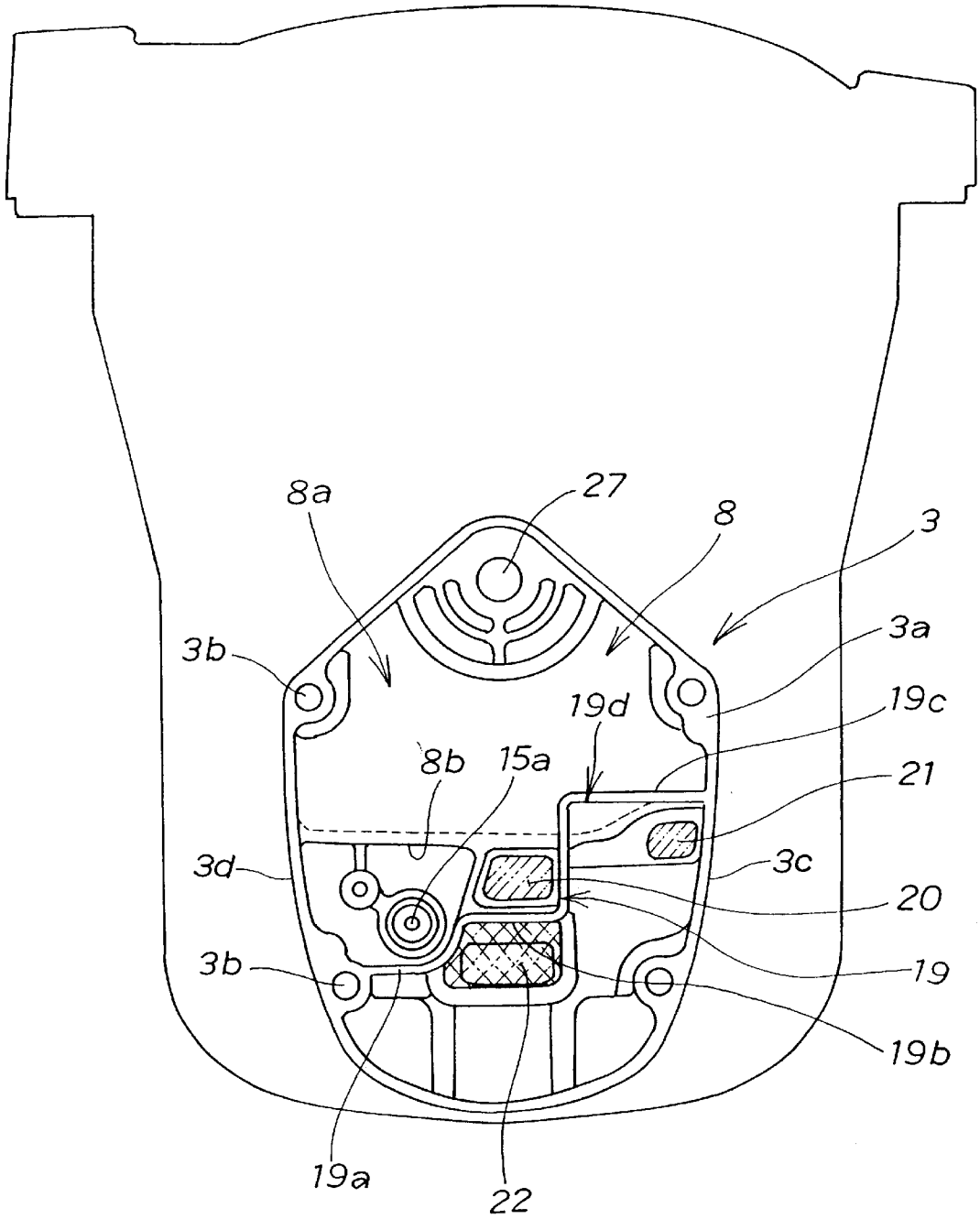
FIG. 4 is a cross-sectional view taken along line 3—3 of FIG. 3, showing a bottom part of the first case.

As shown in FIG. 4, the first cooling water discharge passageway 20 is separated from the oil pan 8 and the passage 22 by the outer wall 8b and the wall portions 19*a*, 19*b*. The passageways 20 communicates with the cavity 25 separated from the passage 24 by the wall 23 as shown in FIG. 3. The second cooling water discharge passageway 21 communicates with the passage 24. Thus, it becomes possible to lower temperature in the passage 24. The flow of cooling water will be described later.

The drive shaft 10 extends vertically within the cavity 25. The drive shaft 10 extends through a through hole 27 formed in the first case 3. The shaft 10 has the upper end portion 10*a* connected to an output end portion 6g of the crankshaft 6*e*.

As best shown in FIG. 4, the vertical wall 19 functions as a partition wall.

The wall 19 disposed within the first case 3 separates the passage 22 from the oil pan 8 and the passageway 20. In addition, the wall 19 separates the passageway 20 and the passageway 21 from each other.

As can be seen from FIG. 4, the first and second cooling water discharge passageways are shown by a hatching of single-dot-and-dash lines. The upper exhaust passage 22 is shown by a cross hatching of single-dot-and-dash lines.

Formed in a front part of the oil pan 8 is the through hole 27 through which the drive shaft 10 is inserted.

Figure 5:
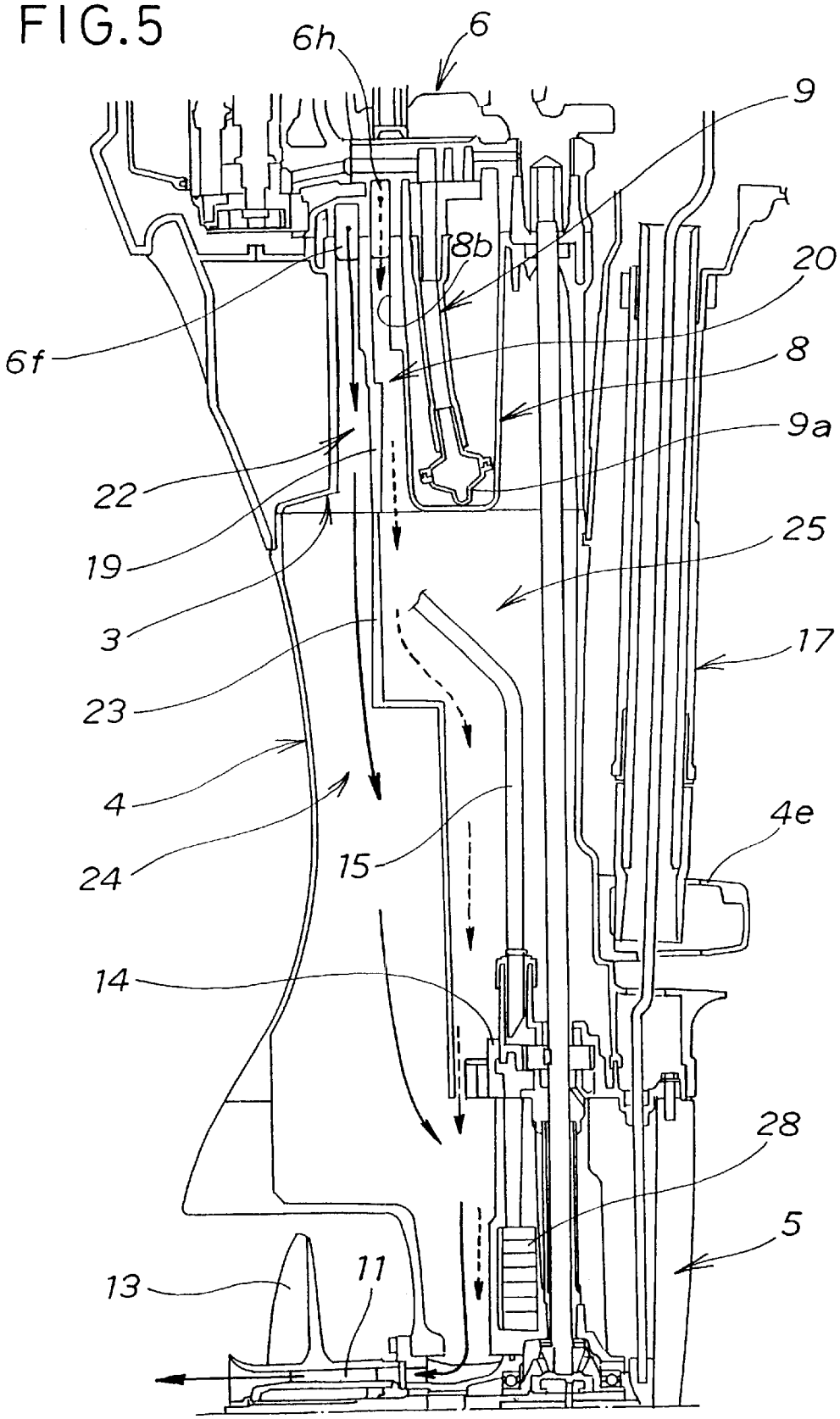
FIG. 5 is a view showing the flow of cooling water and exhaust gas within the outboard motor.

The flow of the exhaust gas and cooling water will be discussed with reference to FIG. 5.

When pumped up by the water pump 14, cooling water, that is, sea water flows through a strainer 28 into the cooling water supply pipe 15. After passing through the pipe 15, the cooling water is supplied to the water jacket and the like (not shown) to thereby cool the engine 6. The cooling water which has cooled the engine 6 flows through the passageways 20, 21 and then exits the outboard motor 1.

More specifically, after cooling the engine 6, the cooling water flows out of a discharge port 6*h*. Part of the cooling water then passes through the passageway 20 into the cavity 25, as shown by broken arrows. At this time, the cooling water flows down the outer wall 8*b* and an inner wall surface of the vertical wall 19 facing towards the oil pan 8. The rest of the cooling water passes through the passageway 21 while cooling the oil pan 8, and then flows into the passage 24.

Exhaust gas flows from the exhaust port 6*f* through the passage 22 into the passage 24, as shown by solid arrows. The exhaust gas then passes along the screw shaft 11 positioned within the gear case 5 disposed below the second case 4, and eventually exits the outboard motor 1.

Although the exhaust passage formed by the passages 22, 24 is provided in the proximity of the oil pan 8 and the cavity 25, the walls 19, 23 separate the exhaust passage from the oil pan 8 and the cavity 25. Accordingly, the oil pan 8 is not affected by heat of the exhaust gas passing through the upper and lower exhaust passages 22, 24. Below the bottom surface 8*a*, there is formed the cavity 25 separated from the passages 22, 24 by the walls 19, 23. Thus, the bottom surface 8*a* is not affected by the heat of the exhaust gas, either.

As far explained, the part of the cooling water flows down the outer wall 8*b* and the inner wall surface of the wall 19 when passing through the passageway 20. When passing through the passageway 21, the rest of the cooling water flows down the outer wall 8*b* and an outer wall surface of the wall 19 opposite from the inner wall surface of the wall 19. The part of the cooling water flows down an inner wall surface of the wall 23 facing forwardly of the outboard motor 1, when passing through the cavity 25. When passing through the passage 24, the rest of the cooling water flows down an outer wall surface of the wall 23 opposite from the inner wall surface. This becomes possible to cool the outer wall 8*b*, the vertical wall 19, and the vertical wall 23. Therefore, the temperature of oil held in the oil pan 8 is not raised by the heat of the exhaust gas. Further, the temperature in the cavity 25 is not raised by the heat of the exhaust gas. Nor is the bottom surface 8*a* increased in temperature by the heat of the exhaust gas.

The part of the cooling water subsequently passes over the water pump 14 into the gear case 5. The rest of the cooling water flows into the gear case 5 through the passage 24. On flowing into the gear case, the part of the cooling water and the rest of the cooling water come together. The cooling water then flows out of the outboard motor 1 together with the exhaust gas.

Some of the exhaust gas undesirably flows up the water pump 14 to the bottom surface 8*a*. However, the exhaust gas is smaller in temperature after reaching the bottom surface 8*a* than immediately after discharged from the engine 6. The oil pan 8 can be effectively cooled by the cooling water.

Figure 6:
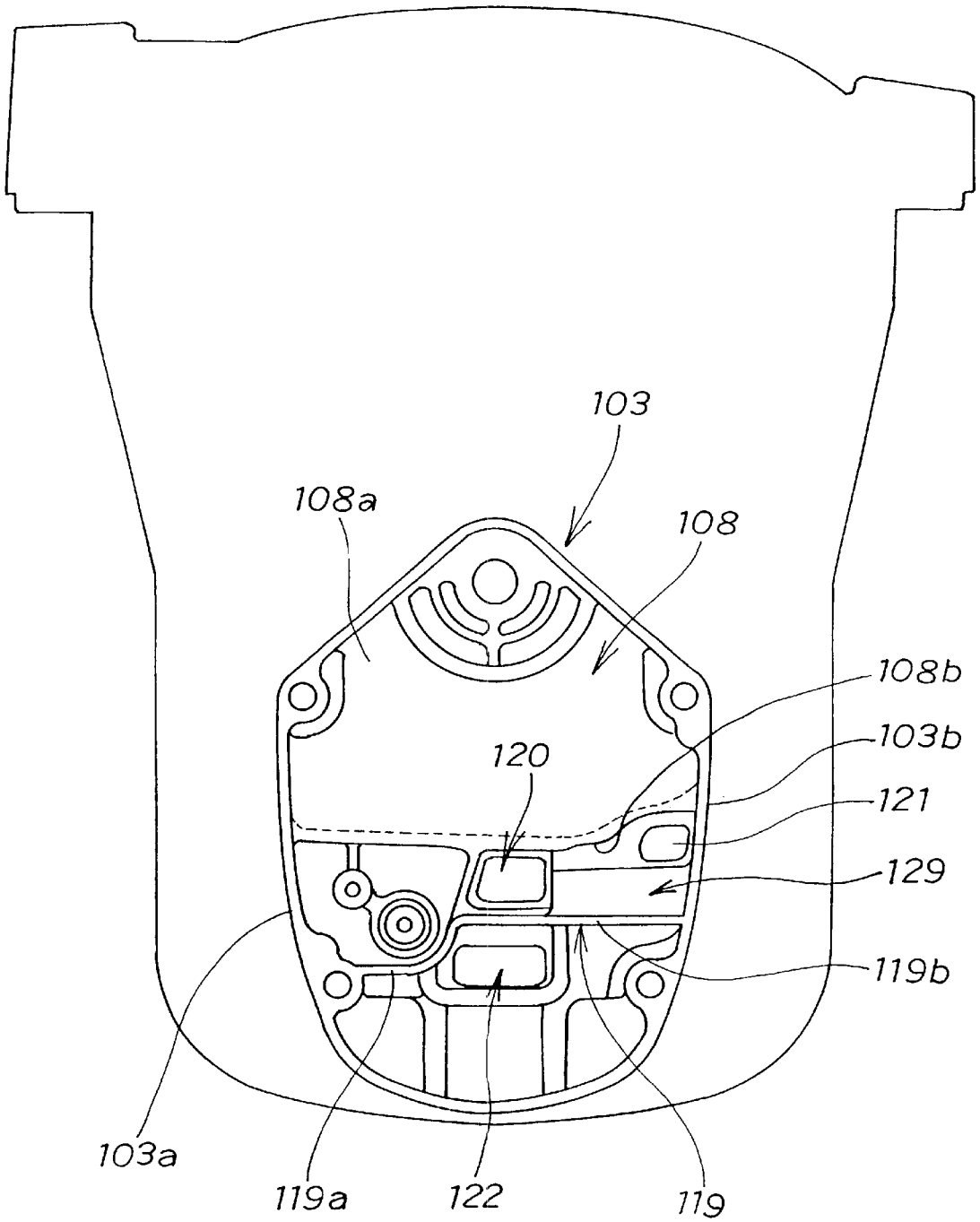
FIG. 6 shows an alternative to the first case in the same manner as FIG. 4.

FIG. 6 shows an alternative to the first case 3.

As shown in FIG. 6, a vertical wall 119 is formed integrally with a first case 103. The wall 119 is positioned between one side 103*a* and another side 103*b* of the first case 103. The wall 119 includes a left half part 119*a* and a right half part 119*b*.

The wall 119 is spaced rearwardly (downwardly in this figure) from an outer wall 108*b* of the oil pan 108. Between the right half part 119*b* and the outer wall 108*b*, there is formed a space 129. First and second cooling water discharge passageways 120, 121 are also provided between the right half part 119*b* and the outer wall 108*b*. Reference numeral 108*a* denotes a bottom surface of the oil pan 108. An upper exhaust passage 122 forms part of an exhaust passage through which exhaust gas passes.

As discussed above, the space 129 and the passageways 120, 121 are formed between the wall 119 and the outer wall 108*b*. In other words, between the oil pan 108 and the exhaust passage, there is provided an thermal insulating layer for preventing the heat of the exhaust gas from passing therethrough. With this arrangement, the transmission of the heat of the exhaust gas to the oil pan 108 can be better prevented.

A second case is disposed below the first case 103. The second case has a vertical wall disposed therewithin. Such a vertical wall divides a space within the second case into a lower exhaust passage and a cavity in the manner as discussed in relation to FIG. 2 and FIG. 3. The lower exhaust passage and the cavity correspond to the lower exhaust passage 24 and the cavity 25, respectively, as shown in FIG. 2. The vertical walls of the first case 103 and the second case have the same configuration, as viewed in plan. The vertical wall 119 includes a bottom edge configured to be coupled to a top edge of the vertical wall of the second case, as previously described. When the bottom edge and the top edge are coupled together, the passageways 120, 121 are brought into communication with the cavity.

Obviously, various minor changes and modifications of the present invention are possible in the light of the above teaching. It is therefore to be understood that within the scope of the appended claims, the present invention may be practiced otherwise than as specifically described.

What is claimed is:

1. An outboard motor comprising:

an engine having a vertically extending crankshaft;

an oil pan disposed below a crankcase of said engine;

a vertically extending drive shaft disposed to be driven by said crankshaft;

a screw positioned at a lower end portion of said drive shaft, said screw extending perpendicularly to said drive shaft, said screw being disposed to be driven by said drive shaft through a gear transmission mechanism;

a first case for housing therein said oil pan and an upper part of said drive shaft, said first case being disposed below said crankcase, said first case having a coupling surface coupled to said crankcase;

a second case for housing therein a lower part of said drive shaft, said second case being disposed below said first case;

a gear case for housing therein said gear transmission mechanism, said gear case being disposed below said second case;

said first case having a vertical wall disposed therewithin to form an exhaust passage through which exhaust gas discharged from said engine passes, such that an outer wall of said oil pan is separated from said exhaust passage by said vertical wall;

said second case having an upper edge portion coupled to a lower edge portion of said first case, said second case having a vertical wall disposed therewithin to form a cavity and an exhaust passage for discharging the exhaust gas into water.

2. The outboard motor as claimed in claim 1, wherein said oil pan is formed integrally with said first case.

3. The outboard motor as claimed in claim 1, including a cooling water supply passage and water discharge passageways all of which are formed therein, said cooling water supply passage being positioned to supply said engine with cooling water for cooling said engine, said water discharge passageways being formed such that after cooling said engine, said cooling water flows out of said outboard motor by passing therethrough, at least one of said water discharge passageways being formed on a side of said outer wall of said oil pan provided inside said vertical wall.

4. The outboard motor as claimed in claim 1, including a cooling water supply passage and water discharge passageways all of which are formed therein, said cooling water supply passage being positioned to supply said engine with cooling water for cooling said engine, said water discharge passageways being formed such that after cooling said engine, said cooling water flows out of said outboard motor by passing therethrough, at least one of said water discharge passageways being formed on a side of said exhaust passage provided outside said vertical wall.

* * * * *